US009513570B2

(12) United States Patent
Shoji et al.

(10) Patent No.: US 9,513,570 B2
(45) Date of Patent: Dec. 6, 2016

(54) ELECTROSTATIC CHARGE IMAGE DEVELOPER, DEVELOPER CARTRIDGE, PROCESS CARTRIDGE, AND IMAGE FORMING APPARATUS

(71) Applicant: FUJI XEROX CO., LTD., Minato-ku, Tokyo (JP)

(72) Inventors: Takeshi Shoji, Kanagawa (JP); Yosuke Tsurumi, Kanagawa (JP); Hiroshi Kamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 23 days.

(21) Appl. No.: 14/526,696

(22) Filed: Oct. 29, 2014

(65) Prior Publication Data

US 2015/0316867 A1 Nov. 5, 2015

(30) Foreign Application Priority Data

Apr. 30, 2014 (JP) ..... 2014-093822

(51) Int. Cl.

| | |
|---|---|
| ***G03G 9/00*** | (2006.01) |
| ***G03G 9/097*** | (2006.01) |
| ***G03G 9/113*** | (2006.01) |
| ***G03G 15/22*** | (2006.01) |
| ***G03G 15/08*** | (2006.01) |
| ***G03G 9/08*** | (2006.01) |

(52) U.S. Cl.

CPC ..... *G03G 9/09708* (2013.01); *G03G 9/0819* (2013.01); *G03G 9/1133* (2013.01); *G03G 15/08* (2013.01); *G03G 15/22* (2013.01); *G03G 2221/183* (2013.01)

(58) Field of Classification Search

CPC ..... G03G 9/1133; G03G 9/0819
USPC ..... 430/108.1, 111.35, 123.51
See application file for complete search history.

(56) References Cited

U.S. PATENT DOCUMENTS 5,631,116 A * 5/1997 Uchida ..... G03G 9/1133 428/407
5,948,582 A * 9/1999 Nakamura ..... G03G 9/0819 399/252

FOREIGN PATENT DOCUMENTS

JP 2006-285145 A 10/2006

* cited by examiner

*Primary Examiner* — Thorl Chea
(74) *Attorney, Agent, or Firm* — Sughrue Mion, PLLC

(57) ABSTRACT

An electrostatic charge image developer contains toner including toner particles, and strontium titanate particles having a volume average particle diameter of 3 μm to 7 μm. The electrostatic charge image developer also contains a carrier including core particle, and a coating layer that coats the core particle and contains a cyclohexyl methacrylate resin.

9 Claims, 2 Drawing Sheets

ELECTROSTATIC CHARGE IMAGE DEVELOPER, DEVELOPER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-093822 filed Apr. 30, 2014.

BACKGROUND

1. Technical Field

The present invention relates to an electrostatic charge image developer, a developer cartridge, a process cartridge, and an image forming apparatus.

2. Related Art

In the related art, in electrophotography, a method of forming an electrostatic charge image on a latent image holding member (photoreceptor) or an electrostatic recording member using various units, and attaching electroscopic particles called toner to develop the electrostatic charge image have been used. In the development of the electrostatic charge image, the toner and a carrier are mixed with each other and frictionally charged for applying positive or negative charges to the toner and used. In general, the carrier is widely divided into a coated carrier including a coating layer on the surface thereof, and a non-coated carrier not including a coating layer, and the coated carrier is good, when considering the life of a developer.

SUMMARY

According to an aspect of the invention, there is provided an electrostatic charge image developer containing:

toner including toner particles, and strontium titanate particles having a volume average particle diameter of 3 μm to 7 μm; and a carrier including core particle, and a coating layer that coats the core particle and contains a cyclohexyl methacrylate resin.

BRIEF DESCRIPTION OF THE DRAWINGS

Exemplary embodiments of the present invention will be described in detail based on the following figures, wherein.

DETAILED DESCRIPTION

Figure 1:
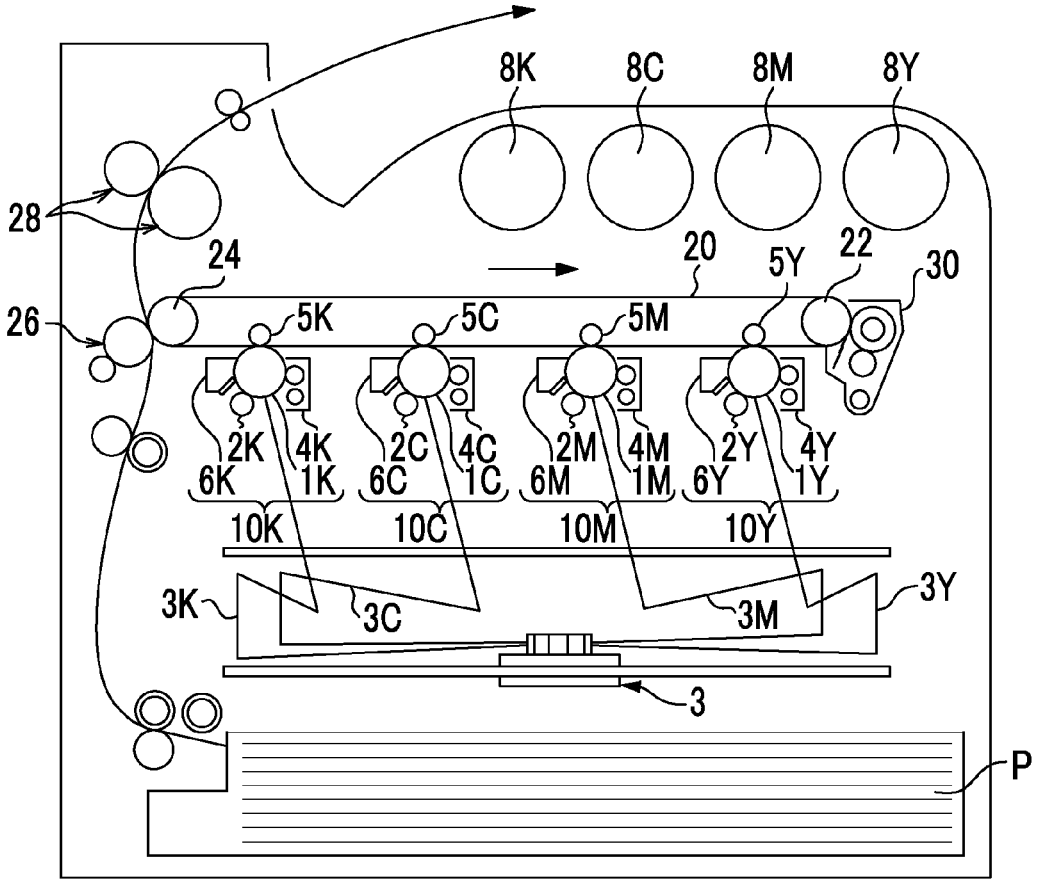
FIG. 1 is a schematic configuration diagram showing an example of an image forming apparatus according to an exemplary embodiment.

Hereinafter, exemplary embodiments which are examples of the invention will be described in detail.

Electrostatic Charge Image Developer

An electrostatic charge image developer according to the exemplary embodiment (hereinafter, also referred to as a "developer") contains toner and a carrier.

The toner includes toner particles and strontium titanate particles having a volume average particle diameter of 3 μm to 7 μm. Meanwhile, the carrier includes core particle, and a coating layer which coats the core particle and contains a cyclohexyl methacrylate resin.

In the related art, a technology of containing strontium titanate particles in the toner has been known, in order to remove discharge products, the toner particles, and external additives attached to a surface of an image holding member (photoreceptor). Accordingly, a cleaning property is given to the toner, and generation of a color stripe on an image is prevented.

Meanwhile, a technology of containing the cyclohexyl methacrylate resin in the coating layer of the carrier, in order to prevent a decrease in charging ability due to moisture absorption in an environment of a high temperature and high humidity (for example, under an environment of a temperature of 28° C. and humidity of 80% RH).

However, it is found that, when the developer is configured with the toner containing the strontium titanate particles and the carrier including a coating layer containing the cyclohexyl methacrylate resin, and a mechanical load is applied to the developer by stirring or the like, a phenomenon in which the strontium titanate particles are embedded into the coating layer of the carrier occurs. In addition, it is found that, particularly when an image having high image density is continuously output in an environment of a high temperature and high humidity (for example, under an environment of a temperature of 28° C. and humidity of 80% RH), a mechanical load applied to the developer increases, and accordingly the phenomenon described above significantly occurs. The reason for this phenomenon is considered because of the usage of the particles having a small diameter of more than 0.3 μm and less than 3 μm, as the strontium titanate particles.

When the phenomenon in which the strontium titanate particles are embedded into the coating layer of the carrier occurs, the cleaning property of the toner is not sufficiently exhibited, and a color stripe is generated on an image.

Therefore, in the developer according to the exemplary embodiment, the toner including the strontium titanate particles having a volume average particle diameter of 3 μm to 7 μm, and the carrier including the coating layer containing the cyclohexyl methacrylate resin are combined with each other. When the particles having a large diameter as in the range described above are used as the strontium titanate particles of the toner, the strontium titanate particles are not easily embedded into the coating layer of the carrier, even when a mechanical load is applied to the developer. Therefore, the cleaning property of the toner is easily exhibited.

Thus, the developer according to the exemplary embodiment prevents generation of a color stripe on an image. Particularly, even when an image having high image density is continuously output, generation of a color stripe on an image is prevented.

Hereinafter, the developer according to the exemplary embodiment will be described in detail.

Toner

The toner includes the toner particles and the strontium titanate particles. The strontium titanate particles are contained in the toner as an external additive.

Toner Particles

The toner particles contain a binder resin, for example. The toner particles may contain a colorant, a release agent, and another additive, if necessary.

Binder Resin

Examples of the binder resins include a homopolymer of a monomer such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ether (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of the monomers.

Examples of the binder resin include a non-vinyl resin such as an epoxy resin, a polyester resin, a polyurethane resin, a polyamide resin, a cellulose resin, a polyether resin, and a modified rosin, a mixture of these and the vinyl resin, or a graft polymer obtained by polymerizing the vinyl monomer under coexistence thereof.

These binder resins may be used alone or in combination with two or more kinds thereof.

The content of the binder resin is, for example, preferably from 40% by weight to 95% by weight, more preferably from 50% by weight to 90% by weight, and even more preferably from 60% by weight to 85% by weight, with respect to the entirety of the toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination thereof.

The content of the colorant is, for example, preferably from 1% by weight to 30% by weight, and more preferably from 3% by weight to 15% by weight with respect to the entirety of the toner particles.

Release Agent

Examples of the release agent include hydrocarbon-based waxes; natural waxes such as carnauba wax, rice wax, and candelilla wax; synthetic or mineral/petroleum-based waxes such as montan wax; and ester-based waxes such as fatty acid esters and montanic acid esters. The release agent is not limited thereto.

The melting temperature of the release agent is preferably from 50° C. to 110° C., and more preferably from 60° C. to 100° C.

The melting temperature of the release agent is obtained from "melting peak temperature" described in the method of obtaining a melting temperature in JIS K7121-1987 "Testing methods for transition temperatures of plastics", from a DSC curve obtained by differential scanning calorimetry (DSC).

The content of the release agent is, for example, preferably from 1% by weight to 20% by weight and more preferably from 5% by weight to 15% by weight, with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, toner particles having a core/shell structure are preferably composed of, for example, a core containing a binder resin, and if necessary, other additives such as a colorant and a release agent, and a coating layer containing a binder resin.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume particle diameter D84v and a number particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

Strontium Titanate Particles

The strontium titanate particles have a perovskite type crystalline structure, and are, for example, cubic or rectangular particles ($SrTiO_3$ particles).

The volume average particle diameter of the strontium titanate particles is from 3 μm to 7 μm, and is preferably from 4 μm to 6 μm, and is more preferably from 4.5 μm to 5.5 μm, in order to prevent generation of a color stripe on an image.

The volume average particle diameter of the strontium titanate particles is a particle diameter containing primary particles and secondary particles (aggregated particles).

The volume average particle diameter of the strontium titanate particles is measured by observing the surface of the carrier with a scanning type microscope and performing image analysis of inorganic particles attached to the coating layer. Specifically, 50 inorganic particles per one carrier are observed with a scanning type microscope, the maximum diameter and the minimum diameter for each particle are measured by image analysis of the inorganic particles, and an equivalent spherical diameter is measured from a median value thereof. The measurement of the equivalent spherical diameter is performed for 100 carriers. The cumulative percentage of 50% diameter (D50v) of the obtained equivalent spherical diameter is set as the volume average particle diameter of the inorganic particles.

Surfaces of strontium titanate particles are preferably subjected to a hydrophobizing treatment. A well-known surface treatment agent is used as a hydrophobizing agent, and specific examples thereof include a silane coupling agent, silicone oil, and the like.

Examples of the silane coupling agent include hexamethyldisilazane, trimethylchlorosilane, dimethyldichlorosilane, methyl trichlorosilane, allyl dimethyl chlorosilane, benzyl dimethyl chlorosilane, methyl trimethoxysilane, methyl triethoxysilane, isobutyl trimethoxysilane, dimethyl dimethoxy silane, dimethyl diethoxy silane, trimethyl methoxy silane, hydroxy propyl trimethoxysilane, phenyl trimethoxysilane, n-butyl trimethoxysilane, n-hexadecyl trimethoxysilane, n-octadecyl trimethoxy silane, vinyl trimethoxy silane, vinyl triethoxy silane, γ-methacryloxypropyl trimethoxysilane, vinyltriacetoxysilane, and the like.

Examples of the silicone oil include dimethyl polysiloxane, methyl hydrogen polysiloxane, methylphenyl polysiloxane, and the like.

The amount (content) of the strontium titanate particles externally added is preferably from 0.01% by weight to 1.0% by weight, more preferably from 0.05% by weight to 0.5% by weight, and even more preferably from 0.1% by weight to 0.25% by weight, with respect to the toner particles, in order to prevent generation of a color stripe on an image.

The amount (content) of the strontium titanate particles externally added is acquired by quantitative analysis of the fluorescent X-ray intensity. Specifically, first, 200 mg of a mixture of the toner particles and the strontium titanate particles having known concentrations is set as a pellet sample by using an IR tableting tool having a diameter of 13 mm, the pellet sample is precisely weighed, and the fluorescent X-ray intensity of the pellet sample is measured, to obtain peak intensity. In the same manner as described above, the measurement is performed for the pellet sample of which the added amount of the strontium titanate particles is changed, and a calibration curve is created with the results. The quantitative analysis of the content of the constitutional elements (for example, Sr or Ti) of the strontium titanate particles to be an actual measurement target is performed by using this calibration curve. Accordingly, the amount (content) of the strontium titanate particles externally added is calculated.

For example, the measurement of the fluorescent X-ray intensity is performed under the conditions of an X-ray output of 40 V at 70 mA, a measurement area of 10 mmϕ, and the measurement time of 15 minutes, by using an X-ray fluorescence spectrometer (XRF-1500 manufactured by Shimadzu Corporation). When the peak derived from the constitutional elements of the strontium titanate particles to be a measurement target and the peak derived from the other element are overlapped with each other, the intensity of constitutional elements of the strontium titanate particles to be a measurement target may be acquired, after performing analysis with an ICP (inductively coupled plasma) emission spectrometry or an atomic absorption method.

Other External Additive

The other external additive may be externally added to the toner, in addition to the strontium titanate particles.

Examples of the other external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO, $SiO_2$, $K_2O.(TiO_2)$ n, $Al_2O_3.2SiO_2$, $CaCO_3$, $MgCO_3$, $BaSO_4$, $MgSO_4$, and the like.

Surfaces of the inorganic particles used as the other external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the other external additive also include resin particles (resin particles such as polystyrene, PMMA, and melamine resin) and a cleaning aid (e.g., metal salt of higher fatty acid represented by zinc stearate, and fluorine-based polymer particles).

The externally added amount of the other external additive is, for example, preferably from 0.01% by weight to 5% by weight and more preferably from 0.01% by weight to 2.0% by weight, with respect to the toner particles.

Toner Preparing Method

Next, a method of preparing a toner according to the exemplary embodiment will be described.

The toner according to the exemplary embodiment is obtained by externally adding an external additive to toner particles after preparing of the toner particles.

The toner particles may be prepared using any of a dry process (e.g., kneading and pulverizing method) and a wet process (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

The toner according to this exemplary embodiment is prepared by adding and mixing an external additive with dry toner particles that have been obtained. The mixing is preferably performed with, for example, a V-blender, a Henschel mixer, a Lodige mixer, or the like. Furthermore, if necessary, coarse toner particles may be removed using a vibration sieving machine, a wind classifier, or the like.

Carrier

The carrier includes core particle and a coating layer for coating the core particle.

Core Particles

Examples of the core particles include magnetic metal particles (for example, particles of iron, steel, nickel, or cobalt), magnetic oxide particles (for example, particles of ferrite or magnetite), dispersion resin particles obtained by dispersing these particles in a resin, and the like. As the core particles, particles obtained by impregnating porous magnetic powder with a resin are also used.

The core particles are preferably ferrite particles represented by the following formula, for example.

$$(MO)_X(Fe_2O_3)_Y \qquad \text{Formula:}$$

In the formula, Y represents a value of 2.1 to 2.4 and X represents 3−Y. M represents a metal element, and at least Mn is preferably contained as the metal element.

As M, Mn is used as a main element, but at least one kind selected from the group consisting of Li, Ca, Sr, Sn, Cu, Zn, Ba, Mg, and Ti (preferably, a group consisting of Li, Ca, Sr, Mg, and Ti, in the environment aspect) may be combined.

The core particles are obtained by magnetic granulation and sintering, but a magnetic material may be pulverized as pretreatment. A pulverizing method is not particularly limited, and a well-known pulverizing method is used. Specifically, the method thereof may be performed by using a mortar, a ball mill, a jet mill, and the like.

Herein, the resins contained in the dispersion resin particles as the core particles is not particularly limited, and examples thereof include styrene resins, acrylic resins, phenolic resins, melamine resins, epoxy resins, urethane resins, polyester resins, silicone resins, and the like. In addition, the dispersion resin particles as the core particles may further contain the other component such as a charge-controlling agent or a fluorine-containing particle, depending on the purpose.

The volume average particle diameter of the core particles is, for example, preferably from 10 μm to 500 μm, more preferably from 20 μm to 100 μm, and even more preferably from 25 μm to 60 μm.

Coating Layer

The coating layer includes a coating resin. As the coating resin, the cyclohexyl methacrylate resin is used.

The cyclohexyl methacrylate resin may be a homopolymer of cyclohexyl methacrylate, or may be a copolymer of cyclohexyl methacrylate and a monomer other than cyclohexyl methacrylate.

When the cyclohexyl methacrylate resin is a copolymer, a rate of a repeating unit derived from cyclohexyl methacrylate with respect to the cyclohexyl methacrylate resin is preferably from 50% by mol to 100% by mol, more preferably from 70% by mol to 100% by mol, even more preferably from 80% by mol to 100% by mol.

Examples of the monomer other than cyclohexyl methacrylate include styrene, acrylic acid, methacrylic acid, alkylester methacrylate, and the like. Among these, methyl methacrylate is preferable.

The weight average molecular weight (Mw) of the cyclohexyl methacrylate resin is obtained by molecular weight measurement (polystyrene conversion) by gel permeation chromatography (GPC), and is preferably from 10,000 to 100,000, more preferably 30,000 to 90,000, even more preferably from 40,000 to 80,000.

The coating resin may be used in combination with a coating resin other than the cyclohexyl methacrylate resin. Examples of the other coating resin include an acrylic resin, a polyethylene resin, a polypropylene resin, a polystyrene resin, a polyacrylonitrile resin, a polyvinyl acetate resin, a polyvinyl alcohol resin, a polyvinyl butyral resin, a polyvinyl chloride resin, a polyvinyl carbazole resin, a polyvinyl ether resin, a polyvinyl ketone resin, a vinyl chloride-vinyl acetate copolymer, a styrene-acrylic acid copolymer, a straight silicone resin including an organosiloxane bond or a modified product thereof, a fluororesin, a polyester resin, a polyurethane resin, a polycarbonate resin, a phenol resin, an amino resin, a melamine resin, a benzoguanamine resin, a urea resin, an amide resin, an epoxy resin, and the like.

When the coating resin other than the cyclohexyl methacrylate resin is used in combination, as the coating resin, the rate of the cyclohexyl methacrylate resin occupying the coating layer is preferably from 50% by weight to 100% by weight, more preferably from 70% by weight to 100% by weight, and even more preferably from 80% by weight to 100% by weight. When the resin other than the cyclohexyl methacrylate resin is used in combination, the cyclohexyl methacrylate resin is preferably a resin obtained by singly polymerizing cyclohexyl methacrylate.

In the coating layer, resin particles may be contained in order to control the charging, and conductive particles or the like may be contained in order to control resistance. The coating layer may contain the other additive.

The resin particles are not particularly limited, but the resin particles imparting a charge controlling property are preferable. Examples thereof include melamine resin particles, urea resin particles, urethane resin particles, polyester resin particles, acrylic resin particles, and the like.

The volume average particle diameter of the resin particles is preferably from 80 nm to 200 nm.

Further, a ratio (C/D) of the volume average particle diameter D (μm) of the resin particles in the carrier with respect to the volume average particle diameter C (μm) of the strontium titanate particles in the toner is preferably from 20 to 80.

Examples of the conductive particles include carbon black, various kinds of metal powder, metal oxides (for example, titanium oxide, tin oxide, magnetite, ferrite, and the like). These may be used alone or in combination of two or more kinds thereof. Among these, carbon black particles are preferable, from the viewpoints of excellent manufacturing stability, cost, and conductivity. The kinds of the carbon black are not particularly limited, and carbon black having a DBP oil absorption amount of, approximately, 50 ml/100 g to 250 ml/100 g is preferable, from the viewpoint of excellent manufacturing stability.

As a method of forming the coating layer on the surface of the core particle, a wet process and a dry process are used, for example. The wet process is a process using a solvent for dissolving or dispersing the coating resin of the coating layer. Meanwhile, the dry process is a process not using the solvent described above.

Examples of the wet process include a dipping method of dipping and coating core particles in a coating layer forming resin solution; a spraying method of spraying a coating layer forming resin solution to surfaces of core particles; a fluid bed method of spraying a coating layer forming resin solution in a state in which core particles are fluidized in a fluid bed; and a kneader-coater method in which core particles and a coating layer forming resin solution are mixed with each other in a kneader-coater and the solvent is removed.

As the dry process, a method of forming the coating layer by heating a mixture of the core particles and the coating layer forming material in a dry state is used, for example. Specifically, the core particles and the coating layer forming material are mixed in gas phase, heated, and melted, and the coating layer is formed, for example.

The coating amount of the coating layer with respect to the core particle is, for example, preferably equal to or greater than 0.5% by weight (more preferably from 0.7% by weight to 6% by weight and even more preferably from 1.0% by weight to 5.0% by weight) with respect to the weight of the entire carrier.

The coating amount of the coating layer is acquired as follows.

In a case of a solvent-soluble coating layer, the precisely weighed carrier is dissolved in a soluble solution (for example, toluene), the core particles are held by a magnet, and the solution with the dissolved coating layer is washed. By repeating this several times, the core particles from which the coating layer is removed remain. The core particles are dried, the weight thereof is measured, and a delta is divided by a carrier amount, and accordingly a coating amount is calculated.

Specifically, 20.0 g of the weighed carrier is put in a beaker, 100 g of toluene is added thereto, and the obtained mixture is stirred with a stirring blade for 10 minutes. The magnet is placed on the bottom of the beaker, and toluene is poured off so that the core particles do not flow out. This operation is repeated four times, and the washed beaker is dried. The amount of the dried magnet powder is measured after the drying, and the coating amount is calculated by an equation "(amount of carrier−amount of washed core particles)/amount of carrier".

Meanwhile, in a case of a solvent-insoluble coating layer, the heating is performed using a differential thermogravimetric analyzer Thermo plus EVO II TG8120 manufactured by Rigaku Corporation, in a range of a room temperature (25° C.) to 1000° C. under a nitrogen atmosphere, and the coating amount is calculated with the decrease of the weight thereof.

Properties of Carrier

The volume average particle diameter of the carrier is, for example, from 20 μm to 200 μm, preferably from 25 μm to 60 μm, and more preferably from 25 μm to 40 μm.

Herein, the volume average particle diameter of the carrier is measured as follows. The volume average particle diameter of the core particles is also measured in the same manner.

The particle size distribution is measured by using a laser diffraction/diffusion-type particle size distribution measuring device (LS particle size analyzer manufactured by Beckman Coulter, Inc.). ISOTON-II (manufactured by Beckman Coulter, Inc.) is used as an electrolyte. The number of the particles to be measured is 50,000.

A cumulative distribution by volume is drawn from the side of the smallest diameter with respect to particle size ranges (channels) separated using the particle size distribution obtained by the measurement, and a particle diameter when the cumulative percentage becomes 50% (may be represented as "D50v") is defined as a "volume average particle diameter".

Regarding a magnetic force of the carrier, saturated magnetization in a magnetic field of 1000 Oersteds may be, for example, equal to or greater than 40 emu/g, or may be equal to or greater than 50 emu/g.

Herein, the saturated magnetization of the carrier is measured by using a vibration sample type magnetism-measuring device VSMP 10-15 (manufactured by Toei Industry Co., Ltd.). The measurement samples are put in a cell having an inner diameter of 7 mm and a height of 5 mm and set in the device. The measurement is performed by adding the applied magnetic field, and sweeping is performed to the maximum of 3000 Oersteds. Next, the applied magnetic field is decreased, and a hysteresis curve is created on a recording sheet. The saturated magnetization is acquired from the data of the curve.

The volume electric resistance of the carrier (25° C.), for example, may be from $1\times10^{7}$ Ω·cm to $1\times10^{15}$ Ω·cm, may be from $1\times10^{8}$ Ω·cm to $1\times10^{14}$ Ω·cm, and may be from $1\times10^{8}$ Ω·cm to $1\times10^{13}$ Ω·cm.

The volume electric resistance of the carrier is measured as follows. Measurement targets are evenly placed on a surface of a circular jig with the arranged 20 $cm^2$ electrode plate, so as to have a thickness of 1 mm to 3 mm, and a layer is formed. The 20 $cm^2$ electrode plate is placed thereon to interpose the layer. In order to eliminate gaps between the measurement targets, a load of 4 kg is applied onto the electrode plate disposed on the layer, and the thickness (cm) of the layer is measured. Both electrodes in the upper portion and the lower portion of the layer are connected to an electrometer and a high-voltage power generation device. A high voltage is applied to both electrodes so as to set an electric field to $10^{3.8}$ V/cm, and a current value (A) flowing at that time is read. In the measurement environment, a temperature is set to 20° C. and humidity is set to 50% RH. A calculation equation of the volume electric resistance (Ω·cm) of the measurement target is the following equation.

$$R=E\times20/\{(I-I_0)\times L\}$$

In the equation, R represents a volume electric resistance (Ω·cm) of the measurement target, E represents an applied voltage (V), I represents a current value (A), $I_0$ represents a current value (A) of the applied voltage 0 V, and L represents a thickness (cm) of a layer, respectively. A coefficient 20 represents an area ($cm^2$) of the electrode plate.

The mixing ratio (weight ratio) between the toner and the carrier in the two-component developer is preferably from 1:100 to 30:100, and more preferably from 3:100 to 20:100 (toner:carrier).

The developer according to the exemplary embodiment preferably satisfies following Expression:

$$0.05\leq A/B\leq2$$

wherein A represents a percentage by weight of the cyclohexyl methacrylate resin with respect to the entire carrier; and B represents the volume average particle diameter (μm) of strontium titanate particles.

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that accommodates an electrostatic charge image developer and develops the electrostatic charge image formed on the surface of the image holding member as a toner image with the electrostatic charge image developer, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case where the image forming apparatus according to the exemplary embodiment is an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be described. However, the image forming apparatus is not limited thereto. The major parts shown in the drawing will be described, but descriptions of other parts will be omitted.

FIG. 1 is a schematic configuration diagram showing the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toners, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively.

Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developing roll (an example of the developer holding member). By allowing the surface of the photoreceptor 1Y to pass through the developing device 4Y, the yellow toner electrostatically adheres to the latent image part having been erased on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

Meanwhile, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multi-transferred in a superimposed manner.

The intermediate transfer belt 20 onto which the four color toner images have been multi-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Developer Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 2:
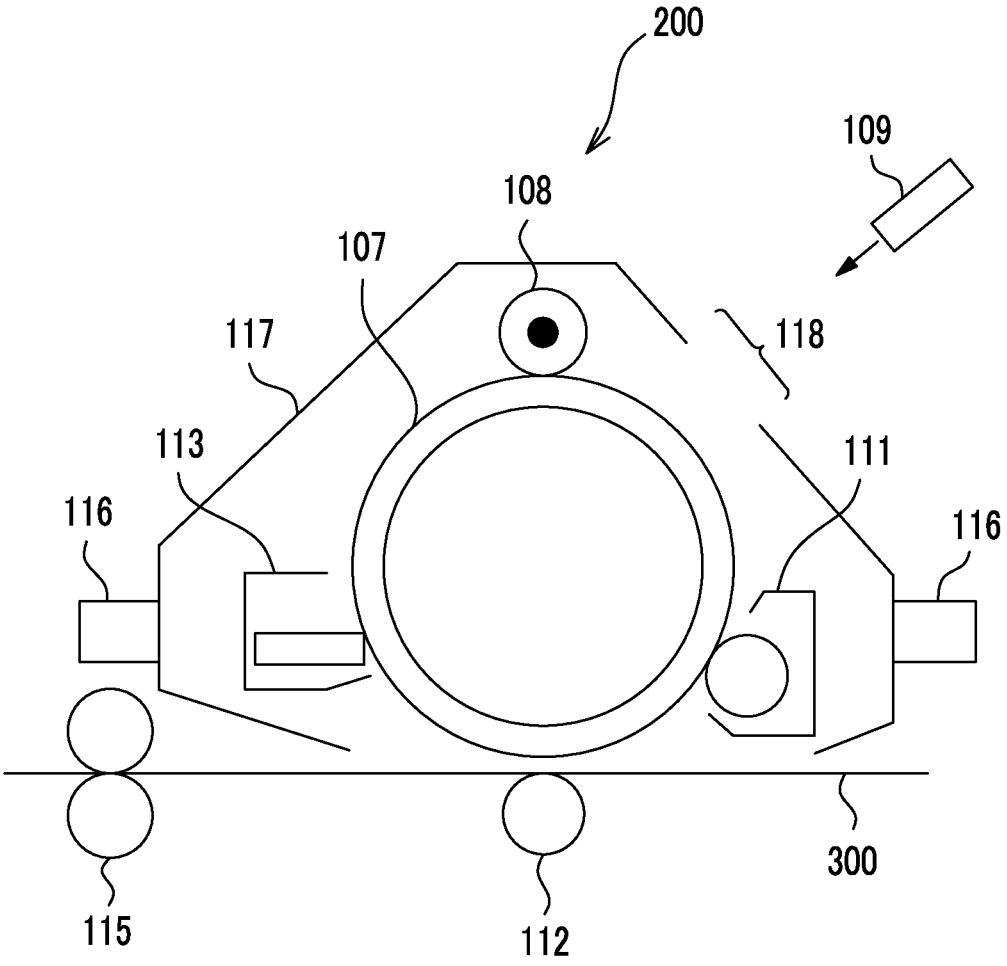
FIG. 2 is a schematic configuration diagram showing an example of an image forming apparatus according to another exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a developer cartridge according to this exemplary embodiment will be described.

The developer cartridge according to this exemplary embodiment accommodates the developer according to this exemplary embodiment and is detachable from an image forming apparatus.

For example, in the image forming apparatus shown in FIG. 1, the toner cartridges 8Y, 8M, 8C, and 8K may be developer cartridges according to the exemplary embodiment. When the developer accommodated in the cartridge runs low, the cartridge is replaced.

EXAMPLES

Hereinafter, the exemplary embodiment will be more specifically described in detail using examples and comparative examples, but is not limited to the following examples. Unless otherwise noted, "part (s)" and "%" are based on weight.

Preparation of Toner

Preparation of Toner 1

Preparation of Colorant Particle Dispersion 1

Cyan pigment: copper phthalocyanine, C. I. Pigment Blue 15:3 (manufactured by Dainichiseika Color & Chemicals Mfg. Co., Ltd.): 50 parts Anionic surfactant: NEOGEN SC (manufactured by Dai-Ichi Kogyo Seiyaku Co., Ltd.): 5 parts Ion exchange water: 200 parts The above components are mixed, and dispersed for 5 minutes using Ultra Turrax manufactured by IKA Japan, K.K., and then dispersed for 10 minutes using an ultrasonic bath, and colorant particle dispersion 1 having solid content of 21% is obtained. When the volume average particle diameter thereof is measured using a particle size distribution measuring device LA-700 manufactured by Horiba, Ltd., the volume average particle diameter thereof is 160 nm.

Preparation of Release Agent Particle Dispersion 1

Paraffin wax: HNP-9 (manufactured by Nippon Seiro Co., Ltd.): 19 parts

Anionic surfactant: NEOGEN SC (manufactured by Dai-Ichi Kogyo Seiyaku Co., Ltd.): 1 part Ion exchange water: 80 parts The above components are mixed in a heat-resistant container, heated to 90° C., and stirred for 30 minutes. Next, the melted solution flows to a homogenizer manufactured by Gaulin from the bottom of the container, a cycle operation equivalent to 3 passes is performed under a pressure condition of 5 MPa. Then, the pressure is increased to 35 MPa, and the cycle operation equivalent to 3 passes is further performed. The emulsified solution obtained as described above is cooled in the heat-resistant container so as to have a temperature to be equal to or lower than 40° C., and the release agent particle dispersion 1 is obtained. When the volume average particle diameter thereof is measured using a particle size distribution measuring device LA-700 manufactured by Horiba, Ltd., the volume average particle diameter thereof is 240 nm.

Preparation of Resin Particle Dispersion 1

Oil Layer

Styrene (manufactured by Wako Pure Chemical Industries, Ltd.): 30 parts n-butyl acrylate (manufactured by Wako Pure Chemical Industries, Ltd.): 10 parts β-carboxyethyl acrylate (manufactured by Rhodia Nicca, Ltd.): 1.3 parts Dodecanethiol (manufactured by Wako Pure Chemical Industries, Ltd.): 0.4 part Aqueous Layer 1

Ion exchange water: 17 parts

Anionic surfactant (DAWFAX2A1 manufactured by The Dow Chemical Company): 0.4 part Aqueous Layer 2

Ion exchange water: 40 parts

Anionic surfactant (DAWFAX2A1 manufactured by The Dow Chemical Company): 0.05 part Ammonium peroxodisulfate (manufactured by Wako Pure Chemical Industries, Ltd.): 0.4 part The above components of the oil layer and the components of the aqueous layer 1 are put in a flask, stirred, and mixed, and monomer emulsified dispersion is obtained. The components of the aqueous layer 2 are put in a reaction vessel, the inside of the vessel is substituted with nitrogen, and the components are heated in an oil bath while stirring, until the temperature of the inside of the reaction system becomes 75° C. The monomer emulsified dispersion is slowly added dropwise into the reaction vessel for 3 hours, and emulsification and polymerization are performed. After the dropwise addition, the polymerization is further continued at 75° C. and is completed after 3 hours, and the resin particle dispersion 1 is obtained.

Preparation of Toner Particles

Resin particle dispersion 1: 150 parts

Colorant particle dispersion 1: 30 parts

Release agent particle dispersion 1: 40 parts

Polyaluminum chloride: 0.4 part

The above components are mixed and dispersed in a stainless steel flask using Ultra Turrax manufactured by IKA Japan, K.K., and then heated to 48° C. while stirring the components in the flask in an oil bath for heating. After holding the mixture at 48° C. for 80 minutes, 70 parts of the resin particle dispersion 1 is added thereto.

Then, after adjusting the pH to 6.0 in the system using aqueous sodium hydroxide having concentration of 0.5 mol/L, the stainless steel flask is sealed, the seal of stirring shaft is sealed with a magnetic force, and the mixture is heated to 97° C. while stirring and held for 3 hours. After completing the reaction, the mixture is cooled at a cooling rate of 1° C./min, and solid-liquid separation is performed by Nutsche-type suction filtration. In addition, the solid content is dispersed again using 3000 parts of ion exchange water at 40° C., stirred and washed at 300 rpm for 15 minutes. This washing operation is repeated 5 times, and the solid-liquid separation is performed by Nutsche-type suction filtration using No. 5A filter paper. Next, vacuum drying is continued for 12 hours, and the toner particles are obtained.

External Addition of External Additive 0.2 part of strontium titanate particles having a volume average particle diameter of 3 μm and 1.0 part of silica ($SiO_2$) particles having a volume average particle diameter of 0.03 μm subjected to surface hydrophobizing treatment with hexamethyldisilazane (hereinafter, may be referred to as "HMDS") are added to 100 parts of the toner particles, and are mixed using a Henschel mixer, and toner 1 is prepared.

Preparation of Toner 2

Toner 2 is prepared in the same manner as the toner 1, except for using the strontium titanate particles having a volume average particle diameter of 4 μm as the strontium titanate particles.

Preparation of Toner 3

Toner 3 is prepared in the same manner as the toner 1, except for using the strontium titanate particles having a volume average particle diameter of 5 μm as the strontium titanate particles.

Preparation of Toner 4

Toner 4 is prepared in the same manner as the toner 1, except for using the strontium titanate particles having a volume average particle diameter of 6 μm as the strontium titanate particles.

Preparation of Toner 5

Toner 5 is prepared in the same manner as the toner 1, except for using the strontium titanate particles having a volume average particle diameter of 7 μm as the strontium titanate particles.

Preparation of Toner 6

Toner 6 is prepared in the same manner as the toner 1, except for using the strontium titanate particles having a volume average particle diameter of 0.2 μm as the strontium titanate particles.

Preparation of Toner 7

Toner 7 is prepared in the same manner as the toner 1, except for using the strontium titanate particles having a volume average particle diameter of 2 μm as the strontium titanate particles.

Preparation of Toner 8

Toner 8 is prepared in the same manner as the toner 1, except for using the strontium titanate particles having a volume average particle diameter of 8 μm as the strontium titanate particles.

Preparation of Carrier

Preparation of Carrier 1

Ferrite particles (Mn—Mg ferrite, volume average particle diameter of 35 μm): 100 parts Toluene: 15 parts Cyclohexyl methacrylate resin (glass transition temperature of 95° C., weight average molecular weight of 55,000): 2.5 parts Resin particles (melamine resin particles, volume average particle diameter of 100 nm): 0.25 part The above components excluding the ferrite particles are dispersed using a homomixer for 3 minutes, and a coating layer forming solution is prepared. After stirring this solution and the ferrite particles for 15 minutes using a vacuum deaeration kneader maintained at 60° C., the pressure is reduced to 5 kPa for 15 minutes to distil toluene, and a carrier 1 in which the coating layer is formed is obtained.

Preparation of Carrier 2

Ferrite particles (Mn—Mg ferrite, volume average particle diameter of 35 μm): 100 parts Toluene: 15 parts Styrene/methyl methacrylate copolymer (glass transition temperature of 71° C., weight average molecular weight of 92,000): 2.5 parts Resin particles (melamine resin particles, volume average particle diameter of 100 nm): 0.25 part The above components excluding the ferrite particles are dispersed using a homomixer for 3 minutes, and a coating layer forming solution is prepared. After stirring this solution and the ferrite particles for 15 minutes using a vacuum deaeration kneader maintained at 60° C., the pressure is reduced to 5 kPa for 15 minutes to distil toluene, and a carrier 2 in which the coating layer is formed is obtained.

Examples 1 to 5 and Comparative Examples 1 to 5

100 parts of the carrier and 8 parts of the toner are mixed with each other according to the combinations disclosed in Table 1, and developers of Examples 1 to 5 and developers of Comparative Examples 1 to 5 are prepared.

Image Quality Evaluation

An output test is performed with respect to the developers obtained in Examples and Comparative Examples, using DocuCentre Color 500 (manufactured by Fuji Xerox Co., Ltd.). A generation state of a color stripe is visually evaluated with images when chart images of pictures of a person are continuously output on 10,000 plain sheets under the environment of a high temperature and high humidity (under the environment of 28° C. and 80% RH).

A case where a color stripe is visually recognized is evaluated as C, a case where a color stripe is barely visually recognized is evaluated as B, and a case where there is no color stripe visually recognized is evaluated as A. The obtained results are shown in Table 1.

TABLE 1

| | Toner | | Carrier | | |
|---|---|---|---|---|---|
| | No. | Strontium titanate particles D50v | No. | Cyclohexyl methacrylate resin in Coating layer | Image quality evaluion (color stripe) |
| Examples 1 | 1 | 3 μm | 1 | Contained | B |
| Examples 2 | 2 | 4 μm | 1 | Contained | A |
| Examples 3 | 3 | 5 μm | 1 | Contained | A |
| Examples 4 | 4 | 6 μm | 1 | Contained | A |
| Examples 5 | 5 | 7 μm | 1 | Contained | B |
| Com. Ex. 1 | 6 | 0.2 μm | 1 | Contained | C |
| Com. Ex. 2 | 6 | 0.2 μm | 2 | None | C |
| Com. Ex. 3 | 1 | 3 μm | 2 | None | C |
| Com. Ex. 4 | 7 | 2 μm | 1 | Contained | C |
| Com. Ex. 5 | 8 | 8 μm | 1 | Contained | C |

From the results described above, it is found that excellent results regarding the image quality evaluation of the color stripe are obtained in the Examples, compared to the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising:

toner including toner particles, and strontium titanate particles having a volume average particle diameter of from 4 μm to 6 μm; and a carrier including core particle, and a coating layer that coats the core particle and contains a cyclohexyl methacrylate resin.

2. The electrostatic charge image developer according to claim 1, that satisfies following Expression:

$$0.05 \leq A/B \leq 2$$

wherein A represents a percentage by weight of the cyclohexyl methacrylate resin with respect to the entire carrier; and B represents the volume average particle diameter (μm) of strontium titanate particles.

3. The electrostatic charge image developer according to claim 1, wherein a content of the coating layer containing the cyclohexyl methacrylate resin is 0.5% by weight to 6.0% by weight with respect to the entire carrier.

4. The electrostatic charge image developer according to claim 1, wherein a weight average molecular weight of the cyclohexyl methacrylate resin is from 30,000 to 90,000.

5. The electrostatic charge image developer according to claim 1, wherein the carrier contains resin particles in the coating layer.

6. The electrostatic charge image developer according to claim 5, wherein a volume average particle diameter of the resin particles is from 80 nm to 200 nm.

7. The electrostatic charge image developer according to claim 5, wherein a ratio (C/D) of the volume average particle diameter D (μm) of the resin particles with respect to the volume average particle diameter C (μm) of strontium titanate particles is from 20 to 80.

8. A developer cartridge that contains the electrostatic charge image developer according to claim 1, and is detachable from an image forming apparatus.

9. A process cartridge comprising:

a developing unit that contains the electrostatic charge image developer according to claim 1, and develops an electrostatic charge image formed on a surface of an image holding member as a toner image with the electrostatic charge image developer, wherein the process cartridge is detachable from an image forming apparatus.

* * * * *